US006247775B1

(12) United States Patent
Walker

(10) Patent No.: US 6,247,775 B1
(45) Date of Patent: Jun. 19, 2001

(54) METHOD AND APPARATUS FOR DETECTING INK LEVEL

(75) Inventor: Ray Allen Walker, Eugene, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/183,071

(22) Filed: Oct. 30, 1998

(51) Int. Cl.[7] ..... B41J 2/195
(52) U.S. Cl. ..... 347/7
(58) Field of Search ..... 347/7, 86; 73/290 R, 73/323; 399/24, 27, 29

(56) References Cited

U.S. PATENT DOCUMENTS

| | | | |
|---|---|---|---|
| 5,073,720 | 12/1991 | Brown | 250/577 |
| 5,508,521 | 4/1996 | Kraft et al. | 250/574 |
| 5,616,929 | 4/1997 | Hara | 250/573 |
| 5,635,961 | 6/1997 | Sato | 347/7 |
| 5,689,290 | 11/1997 | Saito et al. | 347/7 |
| 5,997,121 * | 12/1999 | Altfather et al. | 347/7 |
| 6,012,795 * | 1/2000 | Saito et al. | 347/7 |

* cited by examiner

*Primary Examiner*—John Barlow
*Assistant Examiner*—Craig A. Hallacher
(74) *Attorney, Agent, or Firm*—Kevin B. Sullivan

(57) ABSTRACT

The present disclosure relates to an inkjet printing system for depositing ink on media. The inkjet printing system includes an ink containment vessel formed from a material having optical characteristics selected to block light in the visible light spectrum. Also included is an energy source for providing energy having characteristics that are selected to allow energy passage through the ink containment vessel. Finally, an energy detector is included for detecting energy provided by the energy source that passes through the ink containment vessel. Energy from the energy source impinging upon ink is altered so that an energy detector output signal is indicative of ink within of the ink containment vessel.

15 Claims, 3 Drawing Sheets

METHOD AND APPARATUS FOR DETECTING INK LEVEL

BACKGROUND OF THE INVENTION

The present invention is related to inkjet printing devices. More particularly, the present invention is related to inkjet printing devices that make use of an optical technique for determining ink level in an ink container.

Inkjet printers frequently make use of an inkjet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system not to move with the carriage. For the case where the ink supply is not carried with the carriage, the ink supply can be in fluid communication with the printhead to replenish the printhead or the printhead can be intermittently connected with the ink supply by positioning the printhead proximate to the filling station whereupon the printhead is replenished with ink from the refilling station.

For the case where the ink supply is carried with the carriage, the ink supply may be integral with the printhead where upon the entire printhead and ink supply is replaced when ink is exhausted. Alternatively, the ink supply can be carried with the carriage and be separately replaceable from the printhead or drop ejection portion.

Regardless of where the supply of ink is located within the printing system it is critical that the printhead be prevented from operating when the supply of ink is exhausted. Operation of the printhead once the supply of ink is exhausted results in poor print quality, printhead reliability problems, and if operated for sufficiently long time without a supply of ink can cause catastrophic failure of the printhead. This catastrophic failure results in permanent damage to the printhead. Therefore, it is important that the printing system be capable of reliably identifying a condition where the ink supply is nearly exhausted or exhausted. This technique should be accurate, reliable, and relatively low cost thereby tending to reduce the cost of the printing system.

SUMMARY OF THE INVENTION

The present invention is an inkjet printing system for depositing ink on media. The inkjet printing system includes an ink containment vessel formed of a material having optical characteristics selected to block light in the visible light spectrum. Also included is an energy source for providing, energy having characteristics that are selected to allow energy passage through the ink containment vessel. Finally, an energy detector is included for detecting energy provided by the energy source that passes through the ink containment vessel. Energy from the energy source impinging upon ink is altered so that an energy detector output signal is indicative of ink within the ink containment vessel.

Another aspect of the present invention is an inkjet printing system that includes an ink containment vessel for containing ink. The ink containment vessel has characteristic properties that vary with ink level within the ink containment vessel. An energy source is included for providing energy having an energy characteristic related to the energy source. Energy provided by the energy source impinges on the ink containment vessel. Also provided is an energy detector for detecting energy provided by the energy source. The energy detector is configured to discriminate against ambient energy not having the energy characteristic. The energy detector provides an energy detector output signal indicative of ink level within the ink containment vessel.

In one preferred embodiment, the energy source is an optical light source and a modulator for providing temporal modulation of light energy provided by the optical light source. In this preferred embodiment the energy detector is a bandpass filter that is tuned to a frequency associated with the energy characteristic. Also included in the energy detector is an optical detector for detecting light energy passed by the bandpass filter.

DETAILED DESCRIPTION OF THE PREFERRED EMBODIMENT

Figure 1:
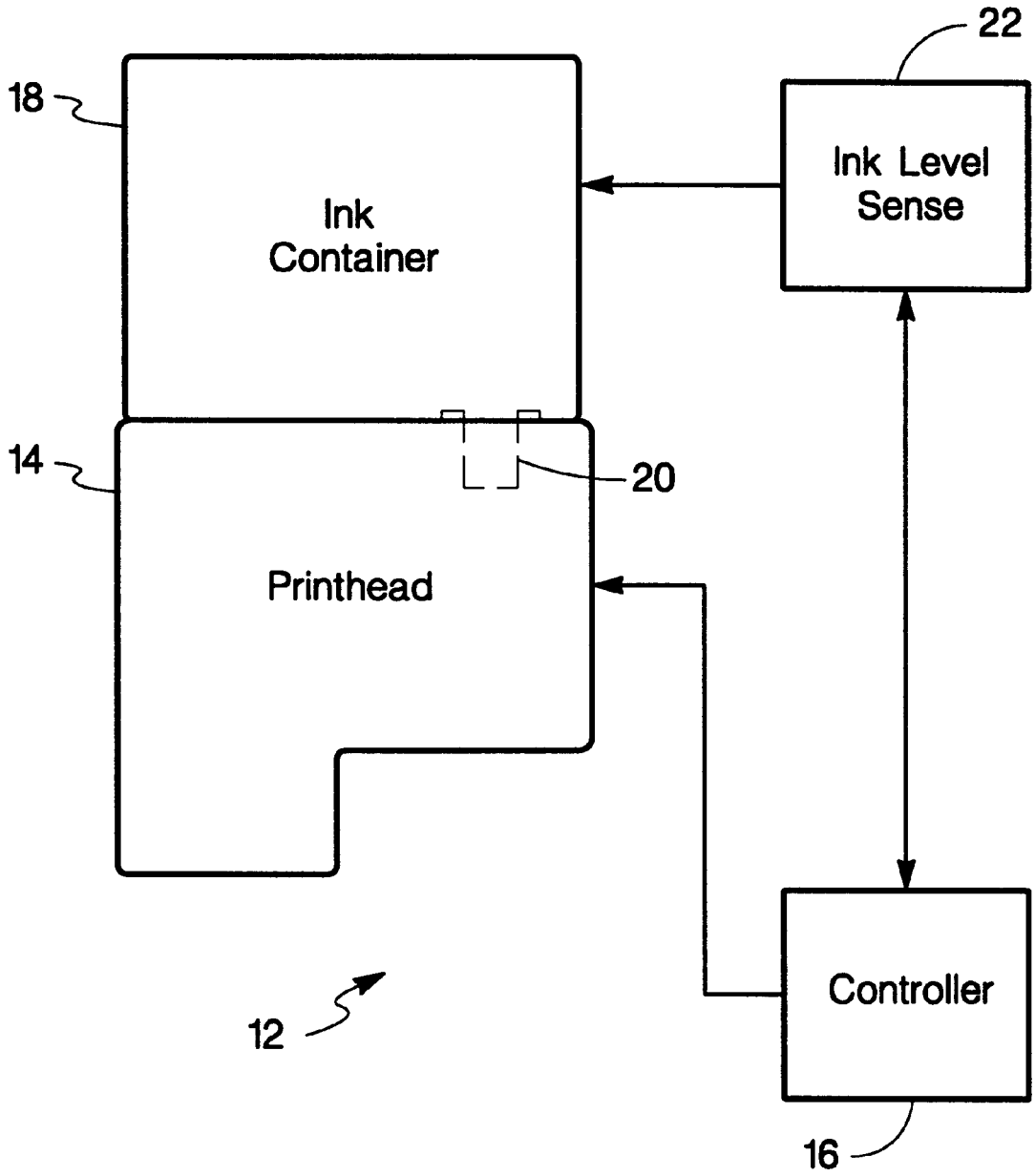
FIG. 1 depicts an inkjet printing system that includes an ink level sensing system for determining ink level in an ink container.

FIG. 1 depicts an inkjet printing system 12 that includes a printhead portion 14 for selectively depositing ink on print media (not shown) under the control of controller 16. Ink is provided to the printhead 14 by ink container 18. The ink container 18 includes a fluid outlet 20 for providing ink to the printhead 14 thereby replenishing the printhead 14 with ink. An ink level sense apparatus determines ink level in the ink container 18 and provides ink level information to the controller 16.

The controller 16 is capable of preventing further operation of the printhead 14 once the ink container is depleted of ink. In addition, the controller 16 provides ink level information to the customer so that a replacement ink container 18 is on hand to avoid interruption in printing.

In the case where the printhead 14 is a thermal inkjet printhead, it is critical that the printhead 14 be prevented from operation without an adequate supply of ink. Operation of the thermal inkjet printhead 14 without an adequate supply of ink can result in reliability problems as well as a reduction in print quality. If operated for a sufficient period of time without an adequate supply of ink the printhead 14 can result in catastrophic failure and permanent printhead damage. It is critical that a low ink or out-of-ink condition for the ink container 18 is detected and that this information be provided to the controller 16 to prevent operation of the printhead 14 to ensure that permanent damage to the printhead 14 does not occur.

The ink level sense apparatus 22 of the present invention provides a reliable and cost efficient method for determining ink level information in the ink container 18 for preventing damage to the printhead 14 as well as providing notification that the ink container 18 is soon in need of replacement.

Although the ink container 18 is shown as a replaceable ink container that mounts directly to the printhead 14, other configurations can also be used in conjunction with the ink level sense apparatus 22 of the present invention. For example, the ink container 18 can be integrally formed with the printhead 14 in which case the entire assembly is replaced when the ink is depleted. For this example, the ink level sense apparatus 22 is used to determine ink level information in the entire assembly. Another example, just to name a few, is where the ink container 18 is mounted off of the scanning carriage. Fluid conduits are provided for fluidically connecting the printhead 14 mounted in the scanning carriage with the ink container 18. In this configuration, the ink level sense apparatus 22 monitors ink level information in the ink container 18 in this off carriage location. An additional ink level sense apparatus can be used to monitor ink level in the printhead portion 14, for additional accuracy.

Figure 2:
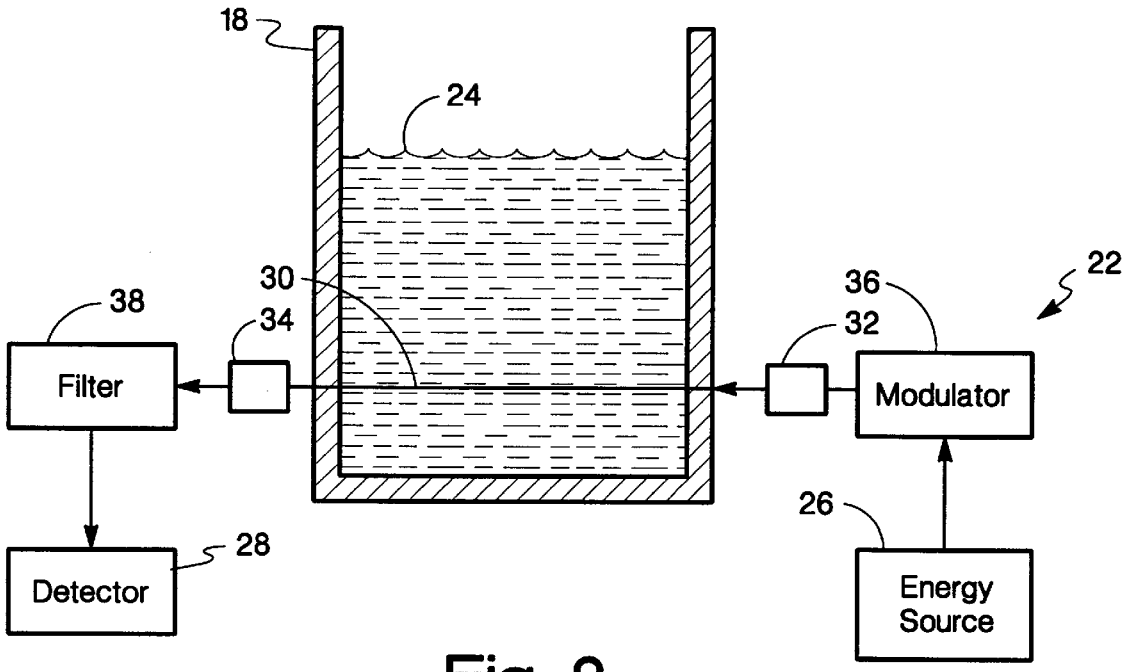
FIG. 2 depicts a first preferred embodiment of the ink level sensing system of the present invention with the ink container shown partially filled with ink.
Figure 3:
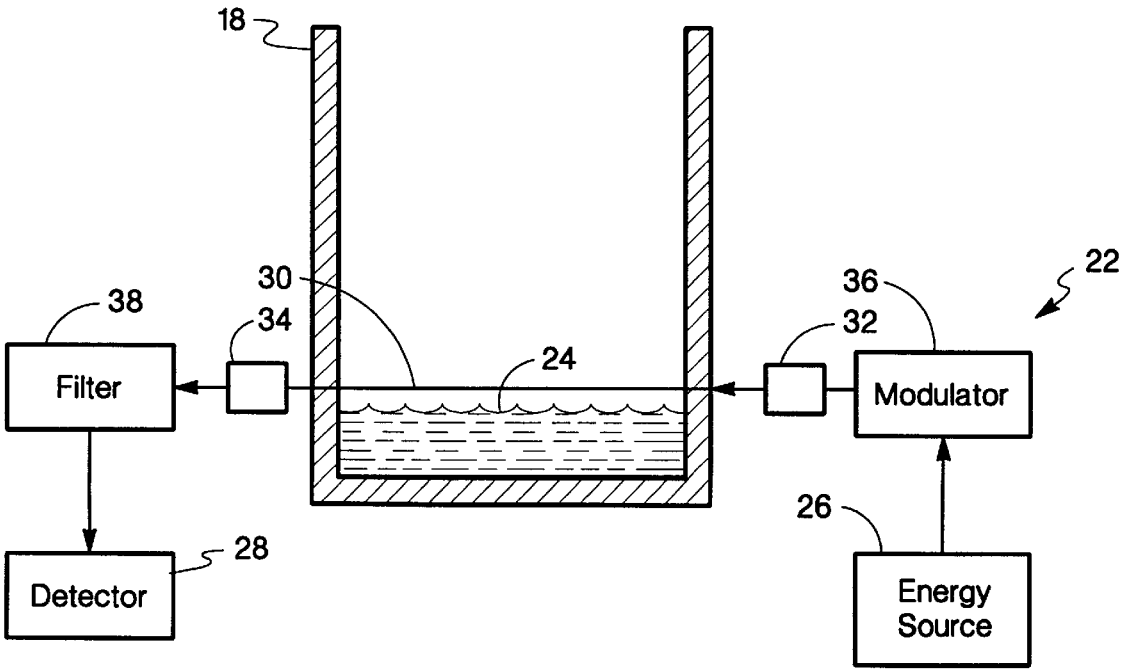
FIG. 3 depicts the ink level sensing system of FIG. 2 shown with the ink container substantially depleted of ink.

FIGS. 2 and 3 depict one preferred embodiment of the ink level sense apparatus 22 of the present invention for determining ink level information in the ink container 18. An ink level 24 represents ink level in the ink container 18. The ink container 18 in FIG. 2 is shown partially filled with ink and the ink container 18 in FIG. 3 is shown substantially depleted of ink.

The ink level sense apparatus 22 of the present invention includes an energy source 26 and an energy detector 28. The energy source 26 provides energy having characteristics that are selected so that emitted energy passes through the ink containment vessel 18 as represented as energy beam 30. The ink container 18 is conversely formed from a material that allows energy provided by the energy source 26 to pass through the ink container 18. Energy passing through the ink container 18, represented by beam 30, is attenuated by ink within the ink container 18. As a result of this attenuation energy received by the detector 28 is either absent or greatly attenuated. The detector 28 provides an output signal to the controller 16 that is indicative of ink level within the ink container 18.

As shown in FIG. 3, once the ink level 24 falls below a threshold level the energy beam 30 is allowed to pass from the energy source 26 to the detector 28 without impinging ink. In this case the detector 28 receives an energy signal of higher intensity that the energy signal received when ink is present to attenuate the signal. The detector output signal is indicative of energy intensity and therefore indicative of whether ink is present at a given ink level in the ink container 18. A plurality of energy beams 30 can be provided at a plurality of different levels on the ink container 18 tor providing ink level information at a plurality of ink levels, if desired.

In the preferred embodiment, the ink container 18 is formed from a material having optical characteristics that are selected to block light or greatly attenuate light in the visible light spectrum. However, the ink container material is substantially transmissive to light from the energy source 26. Therefore, the ink container 18 allows the ink level sense apparatus 22 to sense ink level in the ink container 18 while preventing visible light to pass through the ink container. Preventing visible light to pass through the ink container 18 allows the ink container 18 to more esthetically pleasing. The ink container 18 frequently contains various apparatus such as foam or some form of regulator for ensuring proper back pressure within the printhead 14. As ink is consumed, these pressure regulation devices become visible which is not only unsightly but also can be confusing to the customer. The use of an ink container that does not pass visible light obscures various devices such as back pressure regulating devices from the customer. In addition, the use of ink container materials that greatly attenuate visible light allows the ink container to be color coded for various purposes. One example of the use of color-coding is to identify various parts according to maintenance requirements such as designating customer replaceable parts with a certain color. It is then readily apparent to the customer which things they should replace and which things they should not replace when maintenance is required.

Another example of a use of colored ink containers that substantially block visible light is for color coding the ink containers to aid in installation of the proper ink container in the proper location in the printing system 12. In the case of ink containers that are transparent to visible light it is difficult to determine ink color from visual inspection because the inks tend to be opaque to visible light. The use of ink containers 18 that arc colored using some color coding scheme can aid in the installation of the ink container 18 in the proper location to ensure ink compatibility.

In a preferred embodiment the energy source 26 is an infrared light source. In this preferred embodiment the ink container 18 is formed from a plastic material that is transparent to infrared light. A colorant is added to the plastic that blocks or greatly attenuates visible light, but at the same time is substantially transparent to infrared light. The ink containment vessel 18 allows infrared light to pass through for sensing ink level while at the same time allowing the ink container 18 to be colored to prevent the passage of visible light.

Infrared light provided by the energy source 26 is greatly attenuated or blocked by ink within the ink container 18. As the ink level 24 falls below the energy beam 30 as shown in FIG. 3, infrared light is allowed to pass completely through the ink container 18 from the energy source 26 to the detector 28. In a preferred embodiment, one or more lenses 32 and 34 may be used to collimate or gather light. The lens 32 gathers light energy emitted from the energy source 26 and focuses this energy at a location on the ink container 18. The lens 34 gathers light energy that tends to disperse while passing through the ink container 18 and ink. The lens 34 focuses this gathered light and directs this light to the detector 28. In one preferred embodiment, the energy source 26 and lens 32 are integrated together as a light emitting diode (LED). Alternatively, lens 32 and 34 can be formed integrally with the ink container 18.

In yet another preferred embodiment, the ink level sense apparatus 22 includes a modulator 36 and a filter 38. In this preferred embodiment, the modulator 36 modulates energy provided by the energy source 26. In this preferred embodiment the modulator 36 provides a characteristic to the energy that is emitted by the energy source 26. In one preferred embodiment, the modulator 36 modulates the energy source 26 in a temporal fashion. The use of temporal modulation or pulse modulation of the energy source 26 is to add a characteristic to the energy that does not effect the transmission of energy through the ink container 18. The energy entering the ink container 18 is at a wavelength or frequency that is passed by the ink container. However, the energy is provided in periodic pulses that have a characteristic pulsing frequency. It is this characteristic pulsing frequency that is selectively passed by the filter that allows the ink level sense apparatus 22 of the present invention to discriminate against ambient energy.

The filter 38 is preferably a bandpass filter that is tuned to the modulation or pulse frequency of the modulator 36. The filter 38 tends to discriminate or exclude energy such as ambient energy having characteristic frequencies different from the characteristic frequency of the energy provided by the modulator 36. Therefore, the energy that is passed to the detector 28 is substantially that energy that is produced by the energy source 26. In this manner, the ambient energy such as that from fluorescent lights, as one example, can be discriminated against to provide a greater signal to noise ratio at the detector 28. This improved signal to noise ratio tends to produce a more accurate and reliable ink level sense apparatus 22.

Figure 4:
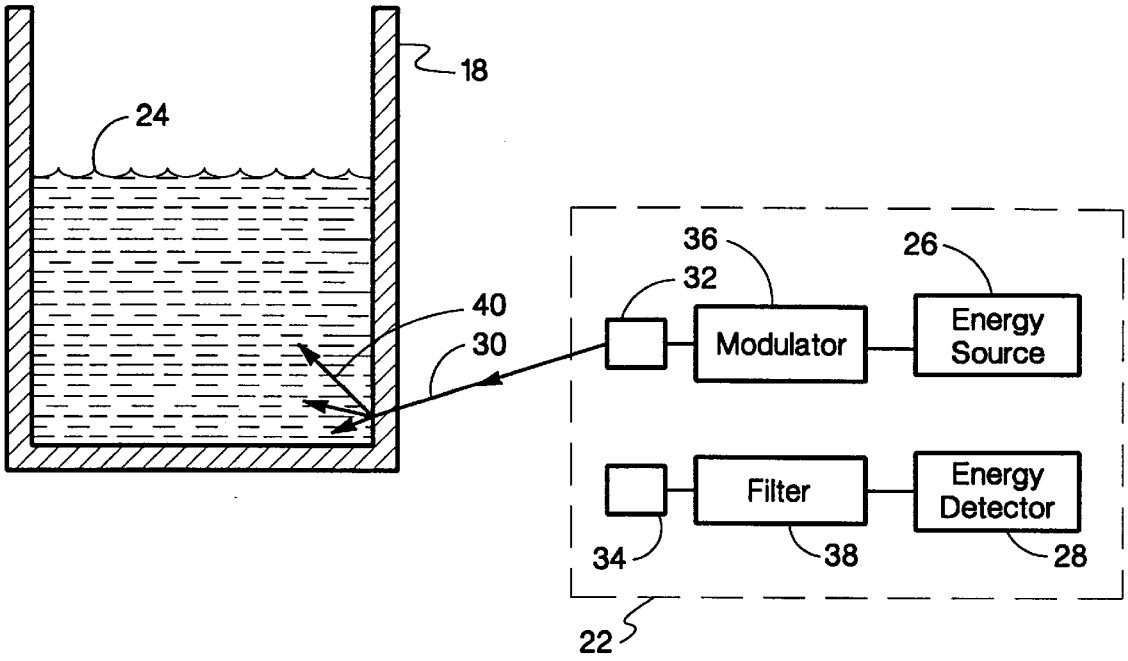
FIG. 4 depicts a second preferred embodiment of the ink level sensing system of the present invention shown with the ink container shown partially filled with ink.
Figure 5:
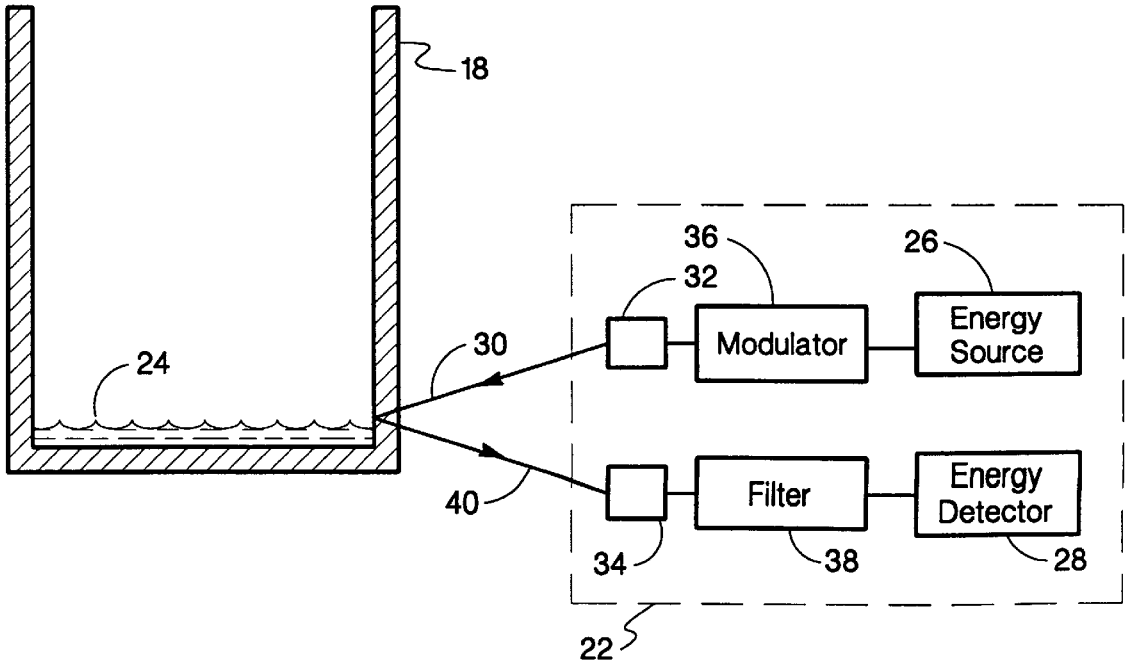
FIG. 5 depicts an ink level sensing system of FIG. 4 shown with the ink container substantially depleted of ink.

FIGS. 4 and 5 show an alternative embodiment to the embodiment shown in FIGS. 2 and 3. Similar numbering is used in this alternative embodiment to represent similarly functioning elements. The embodiment shown in FIG. 4 represents the ink level sense apparatus 22 of the present invention for sensing fluid level in an ink container 18 that is partially filled with ink that is represented by ink level 24. FIG. 5 depicts the ink level sense apparatus 22 of FIG. 4 with the ink level 24 shown below a threshold level in ink container 18.

The ink level sense apparatus 22 is similar to the ink level sense apparatus 22 shown in FIGS. 2 and 3. However, instead of providing energy from the energy source 26 which passes entirely through the ink container 18 to an energy detector 28 disposed adjacent the ink container 18 opposite the energy source 26, both the energy source 26 and the energy detector 28 are disposed on the same side of the ink container 18. The ink level sense apparatus 22 shown in FIGS. 4 and 5 makes use of changes in reflected light resulting from a change in index of refraction within the ink container 18 as ink level 24 falls below a threshold level.

The energy source 26 produces a beam of energy represented by energy beam 30 that is incident on the ink container 18. The ink container 18 is selected from a material that is transmissive to the energy produced by the energy source 26. The ink container 18 is formed from a material that has a characteristic index of refraction. In addition, ink within the ink container 18 also has a characteristic index of refraction. The index of refraction for the ink container 18 is selected to be similar to the index of refraction associated with the ink within ink container 18. At an interface between the ink container 18 and the ink within the ink container 18 the energy beam 30 tends to continue on into the ink container instead of reflecting energy back towards the energy detector 28.

However, in the case where the ink level has fallen below a threshold level as shown in FIG. 5, the incident energy represented by beam 30 at the interface encounters air instead of ink. Air within the ink container 18 has a characteristic index of refraction that is very different from either ink or the ink container material. Because the incident energy represented by energy beam 30 encounters a very different index of refraction at the interface energy tends to be reflected from this interface as represented by beam 40 toward the energy detector 28. Therefore, ink level can be determined by the energy detector 28 by sensing changes in energy intensity for reflected light from a condition where ink is encountered at the interface, as represented by FIG. 4, and for a condition where ink is not encountered at the interface, as represented by FIG. 5. The energy detector 28 provides an output signal to the controller 16 shown in FIG. 1 that is indicative of ink level within the ink container 18.

In one preferred embodiment the ink container 18 is selected from a material that blocks or substantially attenuates transmission of visible light while substantially transmitting energy provided by the energy source 26. In this preferred embodiment the energy source 26 provides energy in the infrared spectrum that is selected to pass through the ink container 1 8 material with little or no attenuation.

In another preferred embodiment the ink level sense apparatus 22 includes a modulator 36 and a filter 38 for improving the signal to noise ratio in a manner similar to the embodiment discussed previously with respect to FIGS. 2 and 3.

In addition, in this preferred embodiment, the ink level sense apparatus includes a light collimator or collector 32 and 34. The light collector 32 tends to collect light from the energy source 26 and focus this light toward the ink container 18. The light collector 34 tends to collect light reflected from the ink container 18 and focus this light to the energy detector 28.

The embodiment shown in FIGS. 4 and 5 allows the ink level sense apparatus 22 to be positioned on one side of the ink container 18. Positioning the ink level sense apparatus 22 on one side of the ink container 18 allows the technique of the present invention to be used in applications where a through beam is undesirable. One example is where the ink container 18 is a plurality of ink containers with each ink container associated with a particular color. In this case, certain orientations of the through beam would require the beam to go through each of the plurality of ink containers. The technique for sensing ink level of the present invention shown in FIGS. 4 and 5 allows positioning of the ink level sense apparatus 22 on one side of the ink containers so that the energy beam need only enter the interface portion of the ink container instead of passing entirely through the ink container 18. This technique is well suited for groupings of ink containers. In addition, because the energy beam does not pass through the ink container 18 this technique is well suited to applications where back pressure devices such as foam or pressure regulators are contained within the ink container 18.

Although, the present invention has been described with respect to determining ink level in an ink container, the present invention is also suitable for determining fluid level in a wide variety of fluid containers. The present invention provides a relative low cost and highly reliable method of determining fluid level. In addition, the present invention allows the fluid container to be opaque or nearly opaque to visible light for applications where this is desirable.

What is claimed is:

1. An inkjet printing system for depositing ink on media, the inkjet printing system including:

an ink containment vessel formed from a material having optical characteristics selected to block light in the visible light spectrum;

an energy source for providing energy having characteristics that are selected to allow energy passage through the ink containment vessel; and an energy detector for detecting energy provided by the energy source passing through the ink containment vessel, wherein energy from the energy source impinging ink is altered so that an energy detector output signal is indicative of ink within in the ink containment vessel.

2. The inkjet printing system of claim 1 wherein the energy source is so disposed and arranged relative to the energy detector to direct energy through the ink containment vessel wherein the energy detector provides an output signal indicative of ink within the ink container disposed between the energy source and the energy detector.

3. The inkjet printing system of claim 1 wherein the energy source is so disposed and arranged relative to the energy detector to direct energy through the ink containment vessel wherein the energy detector provides an output signal indicative of an absence of ink within the ink container disposed between the energy source and the energy detector.

4. The inkjet printing system of claim 1 wherein the energy source is so disposed and arranged relative to the energy detector wherein reflected energy is received by the energy detector based on a relative index of refraction of a region within the ink containment vessel relative to an index of refraction of the ink containment vessel adjacent the region.

5. The inkjet printing system of claim 4 wherein ink present in the region within the ink containment vessel having an index of refraction similar to the index of refraction of the ink containment vessel produces a first reflected energy is received by the energy detector and wherein an absence of ink in the region within the ink containment vessel having an index of refraction dissimilar to the index of refraction of the ink containment vessel produces a second reflected energy received by the energy detector, wherein the second reflected energy is greater than the first reflected energy.

6. The inkjet printing system of claim 4 wherein the energy source for providing energy has energy characteristic related to the energy source, energy provided by the energy source impinges on the ink containment vessel and wherein the energy detector is configured to discriminate against ambient energy not having the energy characteristic.

7. The inkjet printing system of claim 6 wherein the energy source is an optical light source and a modulator for providing temporal modulation of light energy provided by the optical light source.

8. The inkjet printing system of claim 6 wherein the energy detector is a band pass filter that is tuned to a frequency associated with the energy characteristic and an optical detector for detecting light energy passed by the band pass filter.

9. An inkjet printing system for depositing ink on media, the inkjet printing system including:

an ink containment vessel for containing ink, the ink containment vessel having characteristic properties that vary with ink level within the ink containment vessel;

an energy source for providing energy having an energy characteristic related to the energy source, energy provided by the energy source impinging on the ink containment vessel; and an energy detector for detecting energy provided by the energy source, the energy detector configured to discriminate against ambient energy not having the energy characteristic of the energy source, the energy detector providing an energy detector output signal indicative of ink level within the ink containment vessel.

10. The inkjet printing system of claim 9 wherein the energy source is an optical light source and a modulator for providing temporal modulation of light energy provided by the optical light source.

11. The inkjet printing system of claim 9 wherein the energy detector is a band pass filter that is tuned to a frequency associated with the energy characteristic and an optical detector for detecting light energy passed by the band pass filter.

12. The inkjet printing system of claim 9 wherein the ink containment vessel formed from a material having optical characteristics selected to block light in the visible light spectrum and wherein the energy source for providing energy having characteristics that are selected to allow energy passage through the ink containment vessel.

13. An ink containment vessel for providing ink to an inkjet printing system, the inkjet printing system including an ink level sensing system having an energy source that provides energy to the ink containment vessel for determining ink level within the ink containment vessel, the ink containment vessel comprising:

a material forming the ink containment vessel that is selected to block energy in the visible light spectrum; and wherein the ink containment vessel material is selected to pass impinging energy from the energy source associated with the ink level sensing system.

14. The ink containment vessel for providing ink to an inkjet printing system of claim 13 wherein the ink containment vessel is selected to pass light energy in the infrared light spectrum.

15. A method for determining ink level in an ink container, the method comprising:

providing an ink container that has optical characteristics selected to block light in a visible light spectrum;

providing incident energy that impinges on an ink container, the incident energy having characteristics that are selected to allow the incident energy to pass through the ink containment vessel; and receiving energy that has passed through the ink container and determining ink level based on the received energy.

* * * * *